US005927880A

United States Patent [19]

Allison et al.

[11] Patent Number: 5,927,880

[45] Date of Patent: Jul. 27, 1999

[54] COMBINED MARKER AND GLUE STICK DEVICE FOR PLAYING BINGO

[76] Inventors: Sandra B Allison, 13419-117A Ave., Edmonton, Canada, AB T5M 3J6; Bernita B. A. MacLeod; Richard J MacLeod, both of 362 Village Dr, Sherwood Park, Canada, AB T8A 4N3

[21] Appl. No.: 08/935,533

[22] Filed: Sep. 23, 1997

[51] Int. Cl.[6] ..... B43K 8/02; B43K 27/00; B43K 29/00

[52] U.S. Cl. ..... 401/17; 401/23; 401/25; 401/207

[58] Field of Search ..... 401/17, 18, 23, 401/25, 207

[56] References Cited

U.S. PATENT DOCUMENTS

| | | | |
|---|---|---|---|
| 3,393,963 | 7/1968 | Nadai | 401/207 |
| 3,436,163 | 4/1969 | Calabrese et al. | 401/207 |
| 4,035,090 | 7/1977 | Bavaveas | 401/25 |
| 4,557,618 | 12/1985 | Iwata et al. | 401/18 X |
| 4,863,171 | 9/1989 | Rocheleau | 273/148 R |
| 4,869,611 | 9/1989 | Noll | 401/6 |
| 5,222,823 | 6/1993 | Conforti | 401/202 |
| 5,419,592 | 5/1995 | Stuart | 283/102 |

*Primary Examiner*—Steven A. Bratlie
*Attorney, Agent, or Firm*—David S. Thompson

[57] ABSTRACT

A combined marker and glue stick device allows a bingo player to dab or mark a called number using one end of the device and to use the other end of the device to glue the bingo number card to a playing surface. This device facilitates greater speed in card setup and play, and correspondingly increases the chances of winning. The combination marker and glue stick which includes: a tubular body defining an ink compartment within a first end portion and a glue compartment within a second end portion; an ink blotter covering an opening defined in the ink compartment; a glue blotter covering an opening defined in the glue compartment; a removable cap covering the ink blotter; and a removable bottom cap covering the glue blotter.

1 Claim, 1 Drawing Sheet

COMBINED MARKER AND GLUE STICK DEVICE FOR PLAYING BINGO

CROSS-REFERENCES

Figure 1:
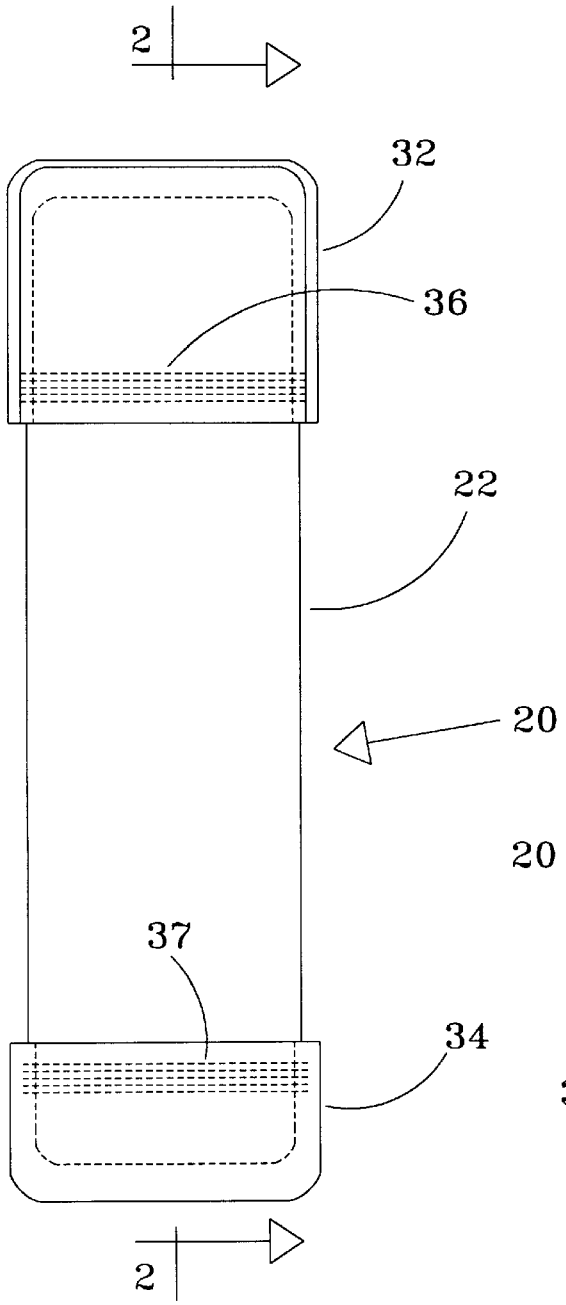

There are no applications related to this application filed in this or any foreign country.

FIELD OF INVENTION

This invention relates to an accessory for playing bingo. More particularly, a combined marker device and glue stick for playing bingo allows a bingo player mark a called number on a bingo card using one end of the device, and to glue the bingo number card to a playing surface with the other end of the device.

BACKGROUND

Bingo has become an increasingly popular game and social event in many communities. To maintain interest and increase chances of winning, bingo players like to purchase and play multiple cards. These cards are spread out on a table in front of the player. Traditionally, as numbers are called the bingo players scan their cards and place buttons on locations on the cards corresponding to a called number. The problem with this traditional method is that accurately placing the buttons is an exacting and time consuming process. If the cards are bumped, the marked locations are frequently lost.

In order to be able to play more cards simultaneously, and to thereby enhance the chance of winning, players desire quicker and more efficient methods of playing. As a result, it is now a wide-spread practice for players to set up prior to play by taping their cards to a playing surface and then proceed to mark called numbers with an ink pen.

What is needed is a single accessory which can be used both to attach cards to a playing surface and to mark called numbers on the cards.

SUMMARY

The present invention is directed to an apparatus that satisfies the above needs. A novel combined marker device and glue stick for playing bingo is disclosed that allows a player to use one end of the apparatus to glue bingo playing cards to a supporting surface, and the other end of the apparatus to mark the numbers on the bingo cards as they are called during the course of the game.

The combined marker and glue stick device for playing bingo of the present invention provides:

(A) A hollow tubular body defining an ink compartment within a first end of the tubular body and a glue compartment within a second end of the tubular body, wherein the ink and glue compartments are isolated by a separating wall.

(B) An ink blotter, adapted for the controlled delivery of an ink supply carried within the ink compartment, covering a circular opening defined in the end of the ink compartment.

(C) A glue blotter, adapted for the controlled delivery of a glue supply carried within the glue compartment, covering a circular opening defined in the end of the glue compartment.

(D) A removable ink compartment cap, threadedly attachable to the tubular body and adapted to cover the ink blotter.

(E) A removable glue compartment cap, threadedly attachable to the tubular body and adapted to cover the glue blotter. In a preferred version of the invention, the glue compartment cap provides a flat end surface, thereby allowing the cap to be supported in an upright position when not in use.

It is a primary object of this invention to disclose a marker which is adapted to mark numbers with a quick downward motion, and which is adapted to glue bingo number cards to a playing surface so that they can't be blown or otherwise moved out of position when or after they are marked.

It is a further object of this invention to disclose a bingo accessory which stores both glue and ink in amounts which are in proportion to their usage by a bingo player.

It is a still further object of this invention to disclose a single product which facilitates greater speed in card setup and play, so that through these efficiencies a player may play more cards and thereby enhance the chance of winning.

These and other features, aspects, and advantages of the present invention will become better understood with reference to the following description and appended claims.

DRAWINGS

Figure 2:
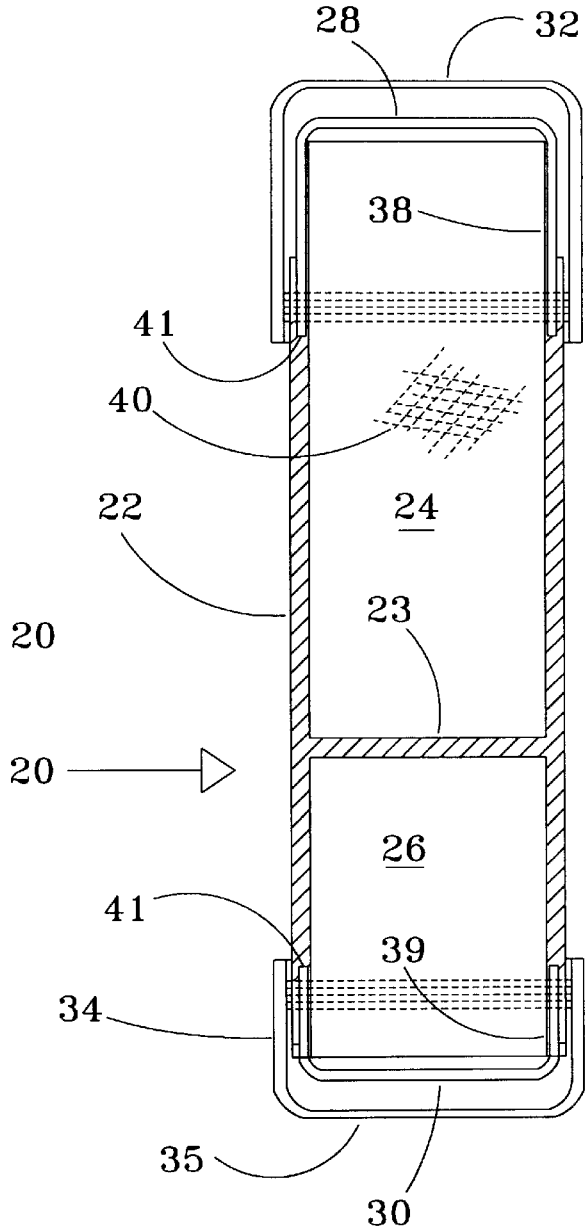

These and other features, aspects, and advantages of the present invention will become better understood with regard to the following description, appended claims, and accompanying drawings where:

FIG. 1 is a side view of a version of the combined marker device and glue stick for playing bingo of the invention; and FIG. 2 is a cross sectional view of apparatus of FIG. 1, taken along 2—2 line.

DESCRIPTION

Referring generally to FIGS. 1 and 2, a combined marker device and glue stick 20 for playing bingo constructed in accordance with the principles of the invention is seen.

The device 20 provides a tubular body 22 defining an ink compartment 24 and a glue compartment 26, isolated by a separating wall 23. In a preferred version of the invention, the ink compartment is approximately twice the volume of the glue compartment, and the tubular body is made of a brightly colored plastic. The tubular body 22 also defines opposed end openings, which are covered by an ink blotter 28 and a glue blotter 30, as will be seen. An upper portion of the tubular body is threaded to receive a removable cap 32 which covers the ink blotter 28. Similarly, a lower portion of the tubular body is threaded to receive a removable cap 34 which covers the glue blotter 30.

Referring to the orientation of the device 20 in FIGS. 1 and 2, an upper end ring 38 and a lower end ring 39 extend from the opposed ends of the tubular body 22. Upper and lower annular grooves 41 form a narrow recess in the ends of the tubular body adjacent to the upper and lower end rings 38, 39. The upper and lower annular grooves 41 are sized to receive the ink blotter 28 and glue blotter 30, respectively, providing a frictional fit, and thereby holding the blotters in place.

In a preferred embodiment of the invention, the ink blotter 28 and glue blotter 30 are made of foam. The thickness and porosity of the foam is selected to allow the ink and glue selected to be transferred through the blotters 28, 30 at an appropriate rate. Because ink has a lower viscosity than glue, the ink blotter 28 is made of a thicker and/or less porous material than the glue blotter 30.

Typically, the ink compartment 24 is filled with a porous fibrous material 40, similar to felt or cotton, to hold and transfer ink. The ink filling the compartment 24 may be any color, including green, yellow, orange, red, blue, purple, pink, turquoise, or gold as well as in special fluorescent and iridescent colors that sparkle.

The glue compartment 26 may be filled with any appropriate type of paste or liquid glue, including glue of the type which is colored when wet, but which dries clear.

A removable cap 32 covers the ink blotter 28, and is threadedly attachable to the threads 36 defined on an upper end of the tubular body 22. In a preferred version of the invention, the removable cap is somewhat elongate, being sized to fit over the elongate upper end ring 38.

A removable cap 34 covers the glue blotter 30, and is threadedly attachable to the threads 37 defined on a lower end of the tubular body 22. In a preferred version of the invention, the removable cap is not as elongate as the cap 32, and is sized to fit over the lower end ring 39, which is shorter than the upper end ring 38. A flat end surface 35 defined on the cap 34 allows the combined marker and glue stick device to be supported in an upright manner when not in use.

In use, the lower end cap 34 is removed and glue or paste is applied through the glue blotter 30 to the backs of one or more bingo cards, which are then adhered to a playing surface, such as a table top. The lower end cap is then replaced.

The upper end cap 32 is then removed as play commences, and the player marks the numbers on the bingo cards corresponding to the numbers called by touching the ink blotter 28 to the bingo cards. After a game is finished, the upper cap is replaced and the combined marker and glue stick device is supported in an upright position on the flat end surface 35 of the lower cap 34.

The invention resides not in any one of these features per se, but rather in the particular combination of all of them herein disclosed and claimed and it is distinguished from the prior art in this particular combination of all of its structures for the functions specified.

The previously described versions of the present invention have many advantages, including a primary object of disclosing a bingo accessory which is adapted to mark numbers with a quick downward motion, and which is adapted to glue bingo number cards to a playing surface so that they can't be blown or otherwise moved out of position when or after they are marked.

It is a further object of this invention to disclose a bingo accessory which stores both glue and ink in amounts which are in proportion to their usage by a bingo player.

It is a still further object of this invention to disclose a single product which facilitates greater speed in card setup and play, so that through these efficiencies a player may play more cards and thereby enhance the chance of winning.

Although the present invention has been described in considerable detail and with reference to certain preferred versions, other versions are possible. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A combined marker and glue stick device comprising:

(A) a hollow tubular body defining an ink compartment within a first end of the tubular body and a glue compartment within a second end of the tubular body, wherein the ink and glue compartments are isolated by a separating wall and wherein the ink compartment is approximately twice the volume of the glue compartment;

(B) an ink compartment end ring and a glue compartment end ring, the end rings extending from the first and second ends of the tubular body, respectively, and wherein the ink compartment end ring is longer than the glue compartment end ring, and wherein the length of the ink compartment end ring is approximately equal to the diameter of the hollow tubular body;

(C) porous material means, carried within the ink compartment and within the ink compartment end ring, for storage of a quantity of ink;

(D) an ink blotter made of foam, adapted for the controlled delivery of ink from the quantity carried within the ink compartment, the ink blotter covering a circular opening defined in the end of the ink compartment and covering an outside surface of the ink compartment end ring;

(E) a glue blotter made of foam, adapted for the controlled delivery of a glue supply carried within the glue compartment, covering a circular opening defined in the end of the glue compartment;

(F) whereby the ink blotter and the glue blotter are attached to annular grooves defined within the first and second ends of the tubular body, respectively, and adjacent to the ink compartment end ring and glue compartment end ring, respectively;

(G) a removable glue compartment cap, threadedly attachable to the second end of the tubular body and adapted to cover the glue blotter, wherein the glue compartment cap defines a flat end surface, thereby allowing the cap to be supported in an upright position when not in use; and (H) a removable ink compartment cap, threadedly attachable to the first end of the tubular body and adapted to cover the ink blotter, wherein the ink compartment cap is elongated to fit over the ink compartment end ring, and wherein the ink compartment cap is therefore longer than the glue compartment cap.

* * * * *